US011658765B2

(12) United States Patent
Choi et al.

(10) Patent No.: US 11,658,765 B2
(45) Date of Patent: May 23, 2023

(54) DEVICE AND METHOD FOR ANTI-JAMMING USING DECOY SIGNAL

(71) Applicant: Daegu Gyeongbuk Institute of Science and Technology, Daegu (KR)

(72) Inventors: Ji Woong Choi, Daegu (KR); Sung Min Han, Daejeon (KR); Sung-Ho Lim, Daegu (KR); Chan Kuen Park, Incheon (KR); Kyung-Joon Park, Daegu (KR); Yongsoon Eun, Daegu (KR)

(73) Assignee: DAEGU GYEONGBUK INSTITUTE OF SCIENCE AND TECHNOLOGY, Daegu (KR)

( * ) Notice: Subject to any disclaimer, the term of this patent is extended or adjusted under 35 U.S.C. 154(b) by 561 days.

(21) Appl. No.: 15/415,110

(22) Filed: Jan. 25, 2017

(65) Prior Publication Data

US 2017/0214486 A1 Jul. 27, 2017

(30) Foreign Application Priority Data

Jan. 25, 2016 (KR) ..... 10-2016-0008920

(51) Int. Cl.
*H04K 3/00* (2006.01)

(52) U.S. Cl.
CPC ..... *H04K 3/226* (2013.01); *H04K 3/65* (2013.01)

(58) Field of Classification Search
CPC ..... H04K 3/00–3/94; H04K 2203/00–2203/36
See application file for complete search history.

(56) References Cited

U.S. PATENT DOCUMENTS 4,143,375 A * 3/1979 Knopf ..... G01S 7/292 342/16
4,179,657 A * 12/1979 Hobbs ..... H04K 1/00 375/285

(Continued)

FOREIGN PATENT DOCUMENTS

KR 20020062001 A * 7/2002 ..... H04K 3/226
KR 10-2011-0106125 9/2011

(Continued)

OTHER PUBLICATIONS

Strategic Beamforming Scheme Using Decoy Signal for Anti-Jamming, Jan. 20-22, 2016 KICS Winter Total Science Conference, Korea, pp. 161-162.

(Continued)

*Primary Examiner* — Matthew M Barker
(74) *Attorney, Agent, or Firm* — Hauptman Ham, LLP

(57) ABSTRACT

A device and method for anti jamming using a decoy signal are provided. The device may include a processor configured to allocate, in connection with a request for transmission of information, first frequency band to information signal including the information and allocate a second frequency band to the decoy signal including fake information associated with the information, and an outputter configured to output the decoy signal and the information signal at a predetermined time interval and output the information signal through the first frequency band after an attack on the second frequency band by the jammer that inspects the decoy signal is detected.

7 Claims, 4 Drawing Sheets

(56) References Cited

U.S. PATENT DOCUMENTS

| | | | | |
|---|---|---|---|---|
| 4,546,356 | A * | 10/1985 | Petitjean | G01S 13/24 342/16 |
| 5,537,117 | A * | 7/1996 | Rose | G01S 7/36 342/17 |
| 7,020,784 | B2 * | 3/2006 | Raphaeli | H04L 63/1416 370/230 |
| 7,042,852 | B2 * | 5/2006 | Hrastar | H04L 63/1408 370/277 |
| 8,060,006 | B2 * | 11/2011 | Hensley | H04K 3/226 455/1 |
| 9,092,962 | B1 * | 7/2015 | Merrill | G08B 25/004 |
| 2007/0037572 | A1 * | 2/2007 | Nanba | H04B 1/1027 455/426.2 |
| 2009/0067340 | A1 * | 3/2009 | Jakobsen | H04K 3/226 370/252 |
| 2011/0033051 | A1 * | 2/2011 | Steer | H04K 3/25 380/270 |
| 2013/0336130 | A1 * | 12/2013 | Kore | H04K 3/222 370/252 |

FOREIGN PATENT DOCUMENTS

| | | |
|---|---|---|
| KR | 10-2013-0083696 | 7/2013 |
| KR | 10-1404454 | 6/2014 |

OTHER PUBLICATIONS

Lang Tong et al., "Blind channel estimation by least squares smoothing," Proceedings of the 1998 IEEE International Conference on Acoustics, Speech and Signal Processing, ICASSP '98 (Cat. No. 98CH36181), 1998, vol. 4, pp. 2121-2124 (DOI: 10.1109/ICASSP.1998.681564).

Hanks H. Zeng et al., "Blind channel estimation using the second-order statistics: algorithms," IEEE Transactions on Signal Processing, Aug. 1997, vol. 45, No. 8, pp. 1919-1930 (DOI: 10.1109/78.611184).

Choo W. R. Chiong et al., "Blind estimation of MIMO relay channels," 2014 IEEE Workshop on Statistical Signal Processing (SSP), 2014, pp. 400-403 (DOI: 10.1109/SSP.2014.6884660).

* cited by examiner

PRIOR ART

DEVICE AND METHOD FOR ANTI-JAMMING USING DECOY SIGNAL

CROSS-REFERENCE TO RELATED APPLICATIONS

This application is a continuation of Korean Application No. KR 10-2016-0008920, filed Jan. 25, 2016, which is incorporated herein by specific reference.

TECHNICAL FIELD

The present invention relates to a device and method for anti-jamming using a decoy signal.

BACKGROUND ART

An anti-jamming technology may remove or reduce an electronic use ability of an enemy that performs an electronic warfare. For example, a frequency hopping spread spectrum (FHSS), a direct sequence spread spectrum (DSSS), an error correcting coding (ECC), an anti jamming beamforming, and a spread spectrum have been used as a related art.

FIG. 1 illustrates an example of a jamming process.

In a related art, information may be transferred from a transmitter 110 to a receiver 130 in a communication system 100. Here, the information may be leaked from the transmitter 110 by a jammer 120 such that the jammer 120 may effectively perform a jamming attack on the receiver 130. That is, the communication system 100 in the related art may be unable to completely prevent a signal (information) from leaking to the jammer 120, such that the jammer 120 may be allowed to perform an effective attack.

Further, when the jammer 120 is provided as a smart jammer specialized for an effective jamming, the jamming may be performed only on key information in a communication, such as, a pilot. That is, the jammer 120 may analyze a communication protocol of a target (receiver) of an attack based on the leaked information and perform a jamming attack only on a key element (pilot signal, timing signal, and acknowledgement (ACK)/negative acknowledgement (NACK) signal) for communication thereby causing a more serious problem.

An anti-jamming beamforming technology of related anti-jamming technologies may minimize a signal received from the jammer 120 and a signal leaked to the jammer 120. In addition, the anti jamming beamforming technology is a technology focused on a method of maximizing a transmission and reception gains directed to the desired transmitter 110 and the receiver 130. However, the anti jamming beamforming technology in the related art has a disadvantage in that a small signal may be leaked to the jammer 120, and the jammer 120 that detects the small signal may obtain information about the communication by analyzing the signal.

In addition, the anti jamming technology in the related art has a disadvantage in that the communication may be difficult due to an effective concentrated attack of the jammer 120 even though beamforming is well performed on the receiver 130 when the signal is leaked from the transmitter 110.

In addition, a spread spectrum technology in the related art has a disadvantage in that it is difficult to be compatible with a commercial communication network in the related art and it shows more deteriorating performance than the anti jamming beamforming technology due to an effect of an overlapping interference source when a processing gain is not great.

Thus, there is a need for a technology that prevents performance deterioration and effectively performs anti jamming with a minimal damage.

DISCLOSURE OF INVENTION

Technical Goals

An aspect of the present invention is to output a decoy signal and an information signal through different frequency bands and protect the information signal from being output to a receiver by directing an attack of a jammer in a false direction based on fake information included in the decoy signal.

Technical Solutions

According to an aspect of the present invention, there is provided a device for anti-jamming using a decoy signal including a processor configured to allocate, in connection with a request for transmission of information, a first frequency band to an information signal including the information and allocate a second frequency band that does not overlap at least the first frequency band to the decoy signal including fake information associated with the information, and an outputter configured to output the decoy signal and the information signal at a predetermined time interval, and, for example, output the decoy signal through the second frequency band and then output the information signal through the first frequency band or output the information signal through the first frequency band after an attack on the second frequency band by a jammer that inspects the decoy signal is detected.

According to another aspect of the present invention, there is provided a method for anti jamming using a decoy signal including allocating, in connection with a request for transmission of information, a first frequency band to an information signal including the information, allocating a second frequency band that does not overlap at least the first frequency band to a decoy signal including fake information associated with the information, and outputting the decoy signal and the information signal at a predetermined time interval and output the information signal through the first frequency band after an attack on the second frequency band by a jammer that inspects the decoy signal is detected.

Effect

According to embodiments of the present invention, it is possible to output a decoy signal and an information signal through different frequency bands and protect the information signal from being output to a receiver by directing an attack of a jammer in a false direction based on fake information included in the decoy signal.

BEST MODE FOR CARRYING OUT THE INVENTION

Figure 1:
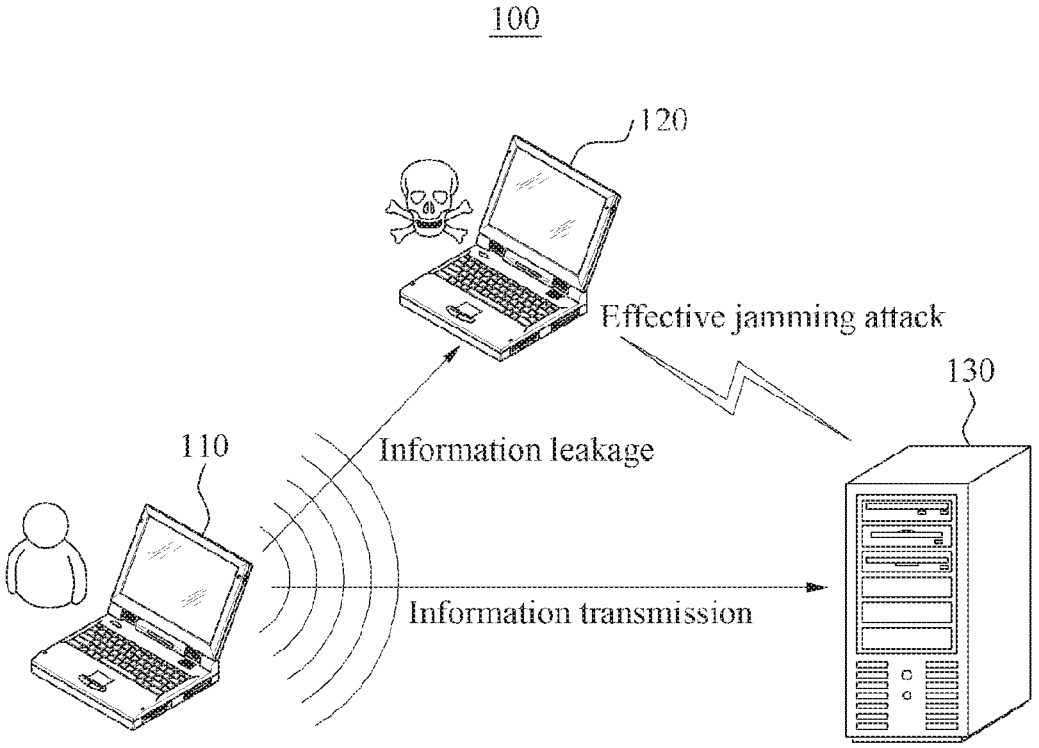
FIG. 1 illustrates an example of a jamming process.

Reference will now be made in detail to embodiments of the present invention, examples of which are illustrated in the accompanying drawings, wherein like reference numerals refer to the like elements throughout. The embodiments are described below in order to explain the present invention by referring to the figures.

A device and method for anti jamming using a decoy signal to be described in the present disclosure may output the decoy signal and an information signal by differently allocating a frequency band that allows a jammer to inspect the decoy signal and a frequency band for outputting the information signal.

Figure 2:
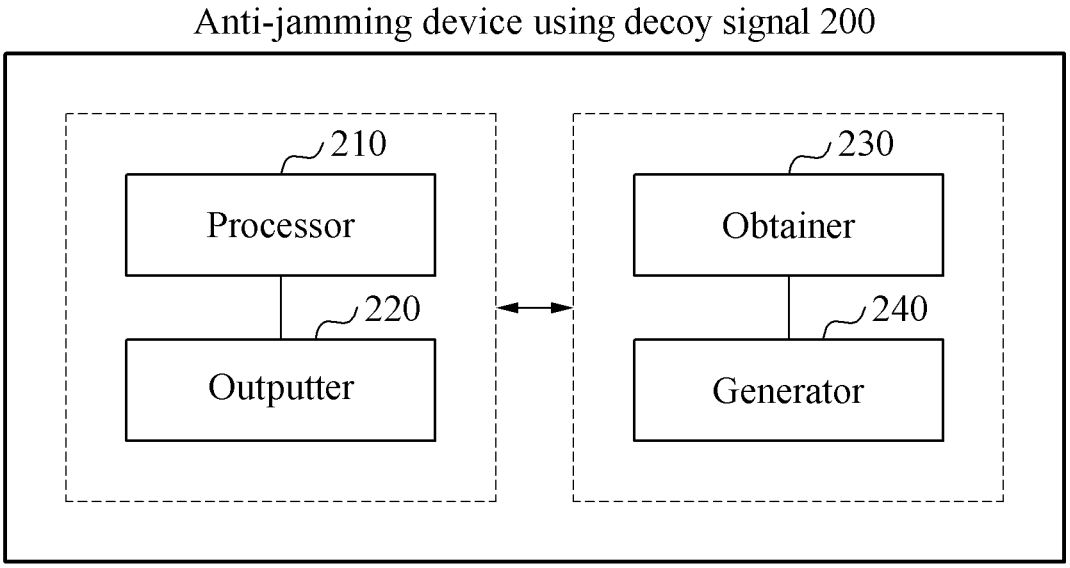
FIG. 2 is a block diagram illustrating an example of a device for anti jamming using a decoy signal.

FIG. 2 is a block diagram illustrating an example of a device for anti jamming using a decoy signal.

The device (hereinafter, referred to as an anti-jamming device 200) for anti-jamming using a decoy signal includes a processor 210 and an outputter 220. In addition, according to an example embodiment, the anti jamming device 200 further includes an obtainer 230 and a generator 240.

In connection with a request for transmission of information, the processor 210 may allocate a first frequency band to information signal including the information and allocate a second frequency band that does not overlap at least the first frequency band to the decoy signal including fake information associated with the information. In addition, the processor 210 may allocate the first frequency band not overlapping the second frequency band to the information signal including the information. That is, the processor 210 may allocate different frequency bands to the information signal and the decoy signal such that the information signal and the decoy signal are output in different frequency bands. The processor 210 may allocate the first frequency band to the information signal and allocate the second frequency band to the decoy signal.

Here, the information signal may be data indicating information output to a receiver. The decoy signal is similar to the information signal but the decoy signal may be data indicating the fake information. The fake information may be data in which a predetermined target (for example, receiver) other than a receiver included in the information signal is set. Detailed description of the decoy signal will be provided with reference to the generator 240 to be described below.

Also, the processor 210 may perform signal processing on the information signal to be divided with respect to at least one of a sign, a time, or a space such that the information signal is not received from a jammer. That is, the processor 210 may perform signal processing on the information signal to be divided by a sign, a time, and a space such that the information signal is not received from the jammer.

The outputter 220 may output the decoy signal and the information signal at a predetermined time interval, and output the information signal through the first frequency band after an attack on the second frequency band by the jammer that inspects the decoy signal is detected. That is, the outputter 220 may output the information signal through the first frequency band when the outputter 220 detects that the decoy signal is inspected through the second frequency band and a jamming wave is transmitted to the second frequency band. As a result, the outputter 220 may output the decoy signal to the jammer through the second frequency band and output the information signal to the receiver through the first frequency band.

In addition, the outputter 220 may output the decoy signal through the second frequency band and output an information signal including the information through the first frequency band to direct the attack on the second frequency band by the jammer. That is, the outputter 220 may output and separate the information signal and the decoy signal through the first frequency band and the second frequency band even when the attack is not detected. Also, the outputter 220 may output the decoy signal through the second frequency band and output the information signal through the first frequency band.

In addition, the outputter 220 may output the decoy signal of which an intensity is greater than an intensity of the information signal through the second frequency band to direct the attack on the second frequency band by the jammer. That is, the outputter 220 may output the decoy signal of which the intensity is great through the second frequency band such that the information signal is safely output by directing the attack.

In addition, the outputter 220 may output the information signal by performing signal processing such that the jammer detects the intensity of the decoy signal as having a greater intensity. That is, the outputter 220 may output the information signal by performing signal processing such that the jammer senses the intensity of the decoy signal having the greater intensity.

In addition, the outputter 220 may output the decoy signal through the second frequency band and detect the attack on the second frequency band by the jammer that inspects the decoy signal. That is, the outputter 220 may output the decoy signal and then detect whether a jamming wave flows into, from the jammer, the second frequency band in which the decoy signal is output. The outputter 220 may verify a result that the jammer receiving the decoy signal misidentifies the second frequency band as a frequency band in which the information signal is output by detecting the attack on the second frequency band.

In addition, the outputter 220 may output the decoy signal through the second frequency band and then output the information signal through the first frequency band or output the information signal through the first frequency band after the attack on the second frequency band by the jammer is detected. That is, the outputter 220 may output the information signal through the safe first frequency band which is not exposed to the jammer because the result of detecting the attack on the second frequency band indicates that the jammer identifies the second frequency band as the frequency band in which the information signal is output.

In addition, the outputter 220 may direct the attack on the second frequency band by the jammer by outputting the decoy signal and the information signal through the first frequency band in response to the intensity of the decoy signal being greater than the intensity of the information signal. That is, the outputter 220 may output the information signal to the first frequency band and output the decoy signal to the second frequency band in response to the intensity of the decoy signal being greater than the intensity of the information signal because an amount of transmission power of the jammer is all transmitted to the decoy signal in response to the intensity of the decoy signal being greater than the intensity of the information signal.

The obtainer 230 may obtain communication channel information allocated to the jammer. That is, the obtainer 230 may obtain the communication channel information on the frequency band used by the jammer.

Here, the processor 210 may allocate the second frequency band based on the communication channel information in response to the communication channel information being obtained from the obtainer 230, and amplify a bandwidth of the first frequency band through a spread spectrum and allocate the second frequency band to a portion of the amplified bandwidth in response to the communication channel information being not obtained from the obtainer 230. That is, the processor 210 may allocate the frequency band used by the jammer as the second frequency band in response to the communication channel information being obtained, and hide the first frequency band in which the information signal is output through the spread spectrum and allocate the portion of the amplified bandwidth of the first frequency band as the second frequency band in response to the communication channel information being not obtained.

In addition, the processor 210 may allocate the first frequency band and the second frequency band to overlap or not to overlap each other based on whether the communication channel information is obtained from the obtainer 230. That is, the processor 210 may allocate the first frequency band and the second frequency band so that the first frequency band and the second frequency band partially overlap or do not overlap each other.

The generator 240 may generate the decoy signal to be identical to a data frame that forms the information signal. That is, the generator 240 may generate the decoy signal including false information (that is, predetermined fake information other than correct information included in information signal). The decoy signal may correspond to the data frame in an identical form of the information signal, but the decoy signal includes the false information.

In addition, the generator 240 may generate the decoy signal of which the intensity is greater than the intensity of the information signal such that an amount of transmission power used to transmit the jamming wave from the jammer is all allocated to the decoy signal. That is, the generator 240 may generate the decoy signal of which the intensity is greater than the intensity of the information signal such that the amount of transmission power of the jammer is not allocated to the information signal because the decoy signal is relatively small compared to the information signal.

In addition, the generator 240 may generate the decoy signal as having the greater intensity than the information signal and allocate, to the decoy signal, the amount of transmission power greater than or equal to a selected ratio (for example, more than half or 90%) of the transmission power used to transmit the jamming wave from the jammer. That is, the generator 240 may generate the decoy signal by determining the intensity of the decoy signal (that is, the intensity of the decoy signal is to be measured to be greater than the intensity of the information signal) in order to allocate most of the transmission power of the jammer to the decoy signal.

In addition, the generator 240 may generate the decoy signal of which the intensity is determined to be in proportion to the amount of transmission power used to transmit the jamming wave from the jammer. That is, the generator 240 may generate the decoy signal by determining the intensity of the decoy signal such that the amount of transmission power of the jammer with respect to the second frequency band is proportionally increased.

The anti-jamming device 200 may output the decoy signal and the information signal through different frequency bands thereby protecting the information signal from being output to a receiver by directing the attack of the jammer in a false direction based on the fake information included in the decoy signal.

Also, the anti-jamming device 200 may perform a key anti-jamming technology by essentially blocking a malicious attack on a physical layer of a military and commercial communication network.

Figure 3:
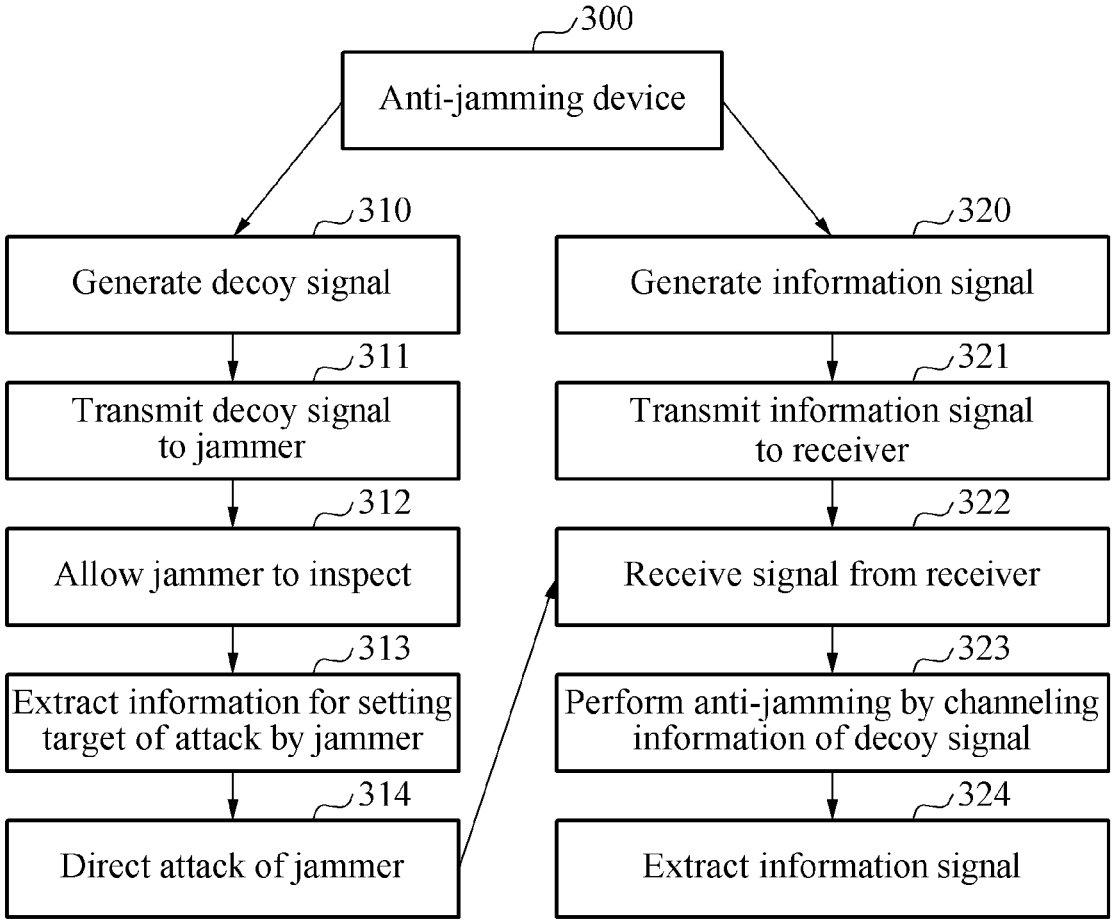
FIG. 3 illustrates an application example using a device for anti-jamming.

FIG. 3 illustrates an application example using a device for anti-jamming.

An anti jamming device 300 may be operated in connection with a request for transmission of information.

In operation 310, the anti jamming device 300 generates a decoy signal including fake information. In operation 320, the anti jamming device 300 generates an information signal including the information.

In operation 311, the anti jamming device 300 transmits (outputs) the decoy signal to a jammer. In operation 321, the anti jamming device 300 transmits the information signal in a desired receiver direction. That is, the anti jamming device 300 may allow the decoy signal to direct an attack of the jammer to a false target of the attack by transmitting the decoy signal to the jammer and transmitting the information signal to a receiver.

The anti-jamming device 300 allows the jammer to inspect the decoy signal in operation 312, extracts the information from the decoy signal for setting a target to be attacked by the jammer in operation 313, and directs the attack to the false target in operation 314 by transmitting the decoy signal to the jammer in operation 311.

In addition, the anti jamming device 300 receives the information on a signal from the receiver in operation 322, performs anti jamming by channeling the information of the decoy signal in operation 323, and extracts the information signal in operation 324 by transmitting the information on the signal, for example, the decoy signal and the information signal, to the receiver.

As a result, the jammer may concentrate most of available transmission power on a falsely set target due to the decoy signal such that the receiver may perform anti jamming by channeling the known information of the decoy signal.

In addition, when the information on a communication channel directed to the jammer is unknown, the anti jamming device 300 may completely hide a frequency band used by the information signal through a spread spectrum and use the decoy signal such that all amount of available transmission power of the jammer is focused on the decoy signal.

Here, the attack by the jammer may be classified into two types and thus, an anti-jamming effect of the anti-jamming device 300 may vary depending on the types.

With respect to an attack that all amount of the available transmission power of the jammer are allocated to a signal of which an intensity is detected to be greatest, the anti-jamming device 300 may completely remove an influence of the jammer because the amount of transmission power of the jammer is not allocated to the information signal of which the intensity is relatively small compared to the decoy signal. That is, the anti jamming device 300 may generate the intensity of the decoy signal as having the intensity greater than the information signal such that the information signal is not attacked by the jammer.

With respect to an attack that the amount of transmission power of the jammer is allocated to be in proportion to intensities of signals to be detected, the anti jamming device 300 may enable an efficiency of the decoy signal to be increased as the amount of the available transmission power of the jammer is increased.

The anti jamming device 300 may neutralize a damage of the information signal caused by a jamming attack by directing the attack such that most of the available transmission power of the jammer is directed in another false direction using the decoy signal. For example, the anti jamming device 300 may be used in a situation in which allies should communicate each other by penetrating a jamming attack of an opponent in a military communication network. Also, in a case of a commercial communication network using multiple communication channels, for example, a wireless fidelity (WiFi) communication network, the anti jamming device 300 may perform an effective anti jamming by directing the attack to other communication channels even though the jammer knows a communication protocol of the target.

In particular, a communication protocol using an orthogonal frequency division multiple access (OFDMA) method may make a number of subcarriers allocated for each user look smaller using a narrowband decoy signal.

Thus, the anti jamming device 300 may allow the jamming attack to be concentrated on a narrowband signal such that an anti jamming performance of the information signal using a wider bandwidth is enhanced.

Accordingly, the anti jamming device 300 may use a false ACK/NACK signal, a timing signal, or a pilot signal as the decoy signal such that damage to various communication resources (time, frequency, space, and code) caused by jamming may be minimized.

Figure 4:
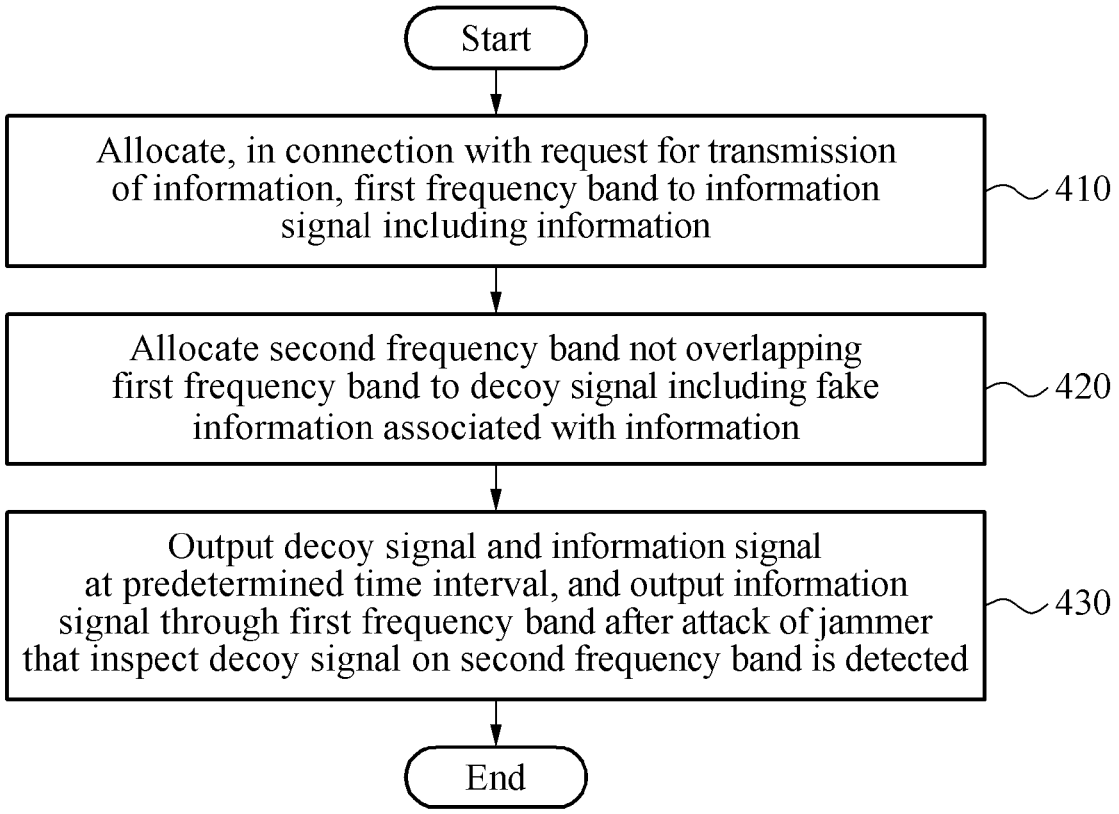
FIG. 4 is a flowchart illustrating an example of a method for anti jamming using a decoy signal.

FIG. 4 is a flowchart illustrating an example of a method for anti jamming using a decoy signal.

The method for anti jamming using the decoy signal may be performed by the anti-jamming device 200 using the decoy signal.

Firstly, in operation 410, the anti jamming device 200 allocates, in connection with a request for transmission of information, a first frequency band to an information signal including the information. Here, the information signal may be data indicating information output to a receiver. That is, operation 410 may be a process of allocating the information signal including the information requested by the receiver to a predetermined frequency band.

Subsequently, in operation 420, the anti jamming device 200 allocates a second frequency band that does not overlap at least the first frequency band to a decoy signal including fake information associated with the information. Here, the decoy signal may be similar to the information signal but may be data indicating the fake information. The fake information may be data in which a predetermined target (for example, receiver) other than the receiver included in the information signal is set. That is, operation 420 may be a process of allocating a frequency band differing from a frequency band of the information signal such that the decoy signal is output to the frequency band differing from the frequency band of the information signal.

Subsequently, in operation 430, the anti jamming device 200 outputs the decoy signal and the information signal at a predetermined time interval, and outputs the information signal through the first frequency band after the decoy signal is output through the second frequency band or outputs or outputs the information signal through the first frequency band after the attack on the second frequency band by the jammer that inspects the decoy signal is detected. That is, operation 430 may be a process of outputting the information signal through the first frequency band when the decoy signal is inspected through the second frequency band and a jamming wave is detected to be transmitted to the second frequency band. As a result, the anti-jamming device 200 may output the decoy signal to the jammer through the second frequency band and output the information signal to the receiver through the first frequency band.

In an example, the anti-jamming device 200 may obtain communication channel information allocated to the jammer. That is, the anti-jamming device 200 may obtain the communication channel information associated with a frequency band used by the jammer.

Here, operation 420 may be a process of allocating the second frequency band based on the communication channel information in response to the communication channel information being obtained, amplifying a bandwidth of the first frequency band through a spread spectrum in response to the communication channel information being not obtained, and allocating the second frequency band to a portion of the amplified bandwidth. That is, the anti jamming device 200 may allocate the frequency band used by the jammer to the second frequency band in response to the communication channel information being obtained, and hide the first frequency band in which the information signal is output through the spread spectrum and allocate the portion of the amplified bandwidth of the first frequency band as the second frequency band in response to the communication channel information being not obtained.

In an example, the anti jamming device 200 may generate the decoy signal to be identical to a data frame that forms the information signal. That is, the anti jamming device 200 may generate the decoy signal including false information (that is, predetermined fake information other than correct information included in information signal). The decoy signal may correspond to the data frame in an identical form of the information signal, but the decoy signal includes the false information.

In an example, the anti-jamming device 200 may generate the decoy signal of which the intensity is greater than the intensity of the information signal and allocate all amount of transmission power used to transmit a jamming wave from the jammer to the decoy signal. That is, the anti jamming device 200 may generate the decoy signal of which the intensity is greater than the intensity of the information signal such that the power transmission of the jammer is not allocated to the information signal because the intensity of the decoy signal is smaller than the intensity of the information signal.

In an example, the anti-jamming device 200 may generate the decoy signal of which the intensity is determined to be in proportion to an amount of the transmission power used to transmit the jamming wave from the jammer. That is, the anti-jamming device 200 may generate the decoy signal by determining the intensity of the decoy signal such that the amount of transmission power of the jammer with respect to the second frequency band is proportionally increased.

In an example, in connection with the request for transmission of the information, the anti jamming device 200 may allocate the second frequency band to the decoy signal including the fake information associated with the information, output the decoy signal and the information signal through the second frequency band, and detect an attack on the second frequency band by the jammer that inspects the decoy signal. That is, the anti jamming device 200 may output the decoy signal through the second frequency band and then detect whether the jamming wave flows into the second frequency band in which the decoy signal is output from the jammer. The anti-jamming device 200 may verify a result that the jammer receiving the decoy signal misidentifies the second frequency band as a frequency band in which the information signal is output by detecting the attack on the second frequency band.

In an example, the anti jamming device 200 may allocate the first frequency band not overlapping the second frequency band to the information signal including the information and output the information signal through the first frequency band after the attack on the second frequency band by the jammer is detected. That is, the anti jamming device 200 may output the information signal through the safe first frequency band which is not exposed to the jammer because the result of detecting the attack on the second frequency band indicates that the jammer identifies the second frequency band as the frequency band in which the information signal is output.

In an example, the anti jamming device 200 may allocate the first frequency band not overlapping the second frequency band to the information signal including the information and simultaneously output the decoy signal and the information signal through the first frequency band in response to the intensity of the decoy signal being greater than the intensity of the information signal to direct the attack on the second frequency band by the jammer. That is, the intensity of the decoy signal is greater than the intensity of the second frequency band and thus, the amount of the transmission power of the jammer may be all allocated to the decoy signal. Thus, the anti-jamming device 200 may output the information signal to the first frequency band and output the decoy signal to the second frequency band in response to the intensity of the decoy signal being greater than the intensity of the information signal.

In an example, the anti jamming device 200 may perform signal processing on the information signal to be divided with respect to at least one of a sign, a time, and a space such that the information signal is not received from the jammer. That is, the anti jamming device 200 may perform signal processing on the information signal to be divided based on the sign, the time, and the space such that the information signal is not received by the jammer.

According to an embodiment, the method for anti jamming may protect an information signal from being output to a receiver by outputting a decoy signal and the information signal through different frequency bands and directing an attack by a jammer in a false direction based on fake information included in the decoy signal.

Further, the method for anti-jamming may perform a key anti-jamming technology by essentially blocking a malicious attack on a physical layer of a military and commercial communication network.

The methods according to the above-described example embodiments may be recorded in non-transitory computer-readable media including program instructions to implement various operations of the above-described example embodiments. The media may also include, alone or in combination with the program instructions, data files, data structures, and the like. The program instructions recorded on the media may be those specially designed and constructed for the purposes of example embodiments, or they may be of the kind well-known and available to those having skill in the computer software arts. Examples of non-transitory computer-readable media include magnetic media such as hard disks, floppy disks, and magnetic tape; optical media such as CD-ROM discs, DVDs, and/or Blue-ray discs; magneto-optical media such as optical discs; and hardware devices that are specially configured to store and perform program instructions, such as read-only memory (ROM), random access memory (RAM), flash memory (e.g., USB flash drives, memory cards, memory sticks, etc.), and the like. Examples of program instructions include both machine code, such as produced by a compiler, and files containing higher level code that may be executed by the computer using an interpreter. The above-described devices may be configured to act as one or more software modules in order to perform the operations of the above-described example embodiments, or vice versa.

While this disclosure includes specific examples, it will be apparent to one of ordinary skill in the art that various changes in form and details may be made in these examples without departing from the spirit and scope of the claims and their equivalents. The examples described herein are to be considered in a descriptive sense only, and not for purposes of limitation. Descriptions of features or aspects in each example are to be considered as being applicable to similar features or aspects in other examples. Suitable results may be achieved if the described techniques are performed in a different order, and/or if components in a described system, architecture, device, or circuit are combined in a different manner, and/or replaced or supplemented by other components or their equivalents.

Therefore, the scope of the disclosure is defined not by the detailed description, but by the claims and their equivalents, and all variations within the scope of the claims and their equivalents are to be construed as being included in the disclosure.

The invention claimed is:

1. A method for anti-jamming using a decoy signal, the method comprising:

allocating, in connection with a request for transmission of the true information signal, a first frequency band to a true information signal including true information;

when communication channel information allocated to a jammer is received, allocating a second frequency band to a decoy information signal including fake information based on the received communication channel information and outputting the decoy information signal using the allocated second frequency band and the true information signal using the allocated first frequency band, respectively, wherein the allocated second frequency band is free from overlapping the first frequency band; and when the communication channel information allocated to a jammer is not received, amplifying bandwidth of the first frequency band through a spread spectrum and allocating, as the second frequency band, a portion of the amplified bandwidth of the first frequency band to the decoy information signal and outputting the decoy information signal using the allocated second frequency band which is the portion of the amplified bandwidth of the first frequency band and the true information signal using the allocated first frequency band, respectively, wherein the true information signal using the allocated first frequency band is outputted after outputting the decoy information signal.

2. The method of claim 1, wherein a data frame's form of the decoy signal is selected to be identical to a data frame's form of the true information signal.

3. An anti-jamming device comprising:

a processor; and a computer-readable hardware storage device having stored thereon computer-executable instructions that are executable by the processor to cause the anti-jamming device to at least:

allocate, in connection with a request for transmission of the true information signal, a first frequency band to a true information signal including true information, when communication channel information allocated to a jammer is received, allocate a second frequency band to a decoy information signal including fake information based on the received communication channel information and output the decoy information signal using the allocated second frequency band and the true information signal using the allocated first frequency band, respectively, wherein the allocated second frequency band is free from overlapping the first frequency band, and when the communication channel information allocated to a jammer is not received, amplify bandwidth of the first frequency band through a spread spectrum, allocate, as the second frequency band, a portion of the amplified bandwidth of the first frequency band to the decoy information signal, and output the decoy information signal using the allocated second frequency band which is the portion of the amplified bandwidth of the first frequency band and the true information signal using the allocated first frequency band, respectively, wherein the true information signal using the allocated first frequency band is outputted after outputting the decoy information signal.

4. The anti-jamming device of claim 3, wherein the decoy information signal is one of the following:

a false ACK/NACK signal, a false timing signal, or a false pilot signal.

5. The anti-jamming device of claim 3, wherein an intensity of the decoy information signal is greater than an intensity of the true information signal.

6. The anti-jamming device of claim 3, wherein execution of the computer-executable instructions further causes the anti-jamming device to:

verify that a jammer, which is conducting a jamming attack by outputting a jamming wave into a particular frequency band, has misidentified the decoy information signal as being the true information signal.

7. An anti-jamming device comprising:

a processor; and a computer-readable hardware storage device having stored thereon computer-executable instructions that are executable by the processor to cause the anti-jamming device to at least:

allocate, in connection with a request for transmission of the true information signal, a first frequency band to a true information signal including true information, when communication channel information allocated to a jammer is received, allocate a second frequency band to a decoy information signal including fake information based on the received communication channel information and output the decoy information signal using the allocated second frequency band and the true information signal using the allocated first frequency band, respectively, wherein the allocated second frequency band is free from overlapping the first frequency band, and when the communication channel information allocated to a jammer is not received, amplify bandwidth of the first frequency band through a spread spectrum, allocate, as the second frequency band, a portion of the amplified bandwidth of the first frequency band to the decoy information signal, and output the decoy information signal using the allocated second frequency band which is the portion of the amplified bandwidth of the first frequency band and the true information signal using the allocated first frequency band, respectively, wherein both the decoy information signal and the true information signal are outputted concurrently with each other.

* * * * *